US005372149A

United States Patent [19]

Roth et al.

[11] Patent Number: 5,372,149

[45] Date of Patent: Dec. 13, 1994

[54] STERILIZATION PROCESS IN THE MANUFACTURING OF SNUFF

[76] Inventors: David S. Roth, 7010 Quail Brace Ct., Louisville, Ky. 40241; William H. Cowart, Jr., 121 Fairlawn Rd.; Carl B. Jenkins, Jr., 3710 Dayton Ave., both of Louisville, Ky. 40207; Denis M. Boyle, 1923 Deerwood Ave., Louisville, Ky. 40205

[21] Appl. No.: 857,364

[22] Filed: Mar. 25, 1992

[51] Int. Cl.[5] ..... A24B 15/18

[52] U.S. Cl. ..... 131/300; 131/290; 435/173.8

[58] Field of Search ..... 131/299, 300, 290; 435/173, 800, 963, 190, 193

[56] References Cited

U.S. PATENT DOCUMENTS

| | | | |
|---|---|---|---|
| Re. 29,298 | 7/1977 | Banks . | |
| 1,327,692 | 1/1920 | Beinhart . | |
| 3,262,458 | 7/1966 | Lindstrom . | |
| 3,494,724 | 2/1970 | Gray | 131/299 X |
| 3,645,849 | 2/1972 | Gray | 435/173 |
| 3,676,058 | 7/1972 | Gray | 131/299 X |
| 3,699,976 | 10/1972 | Abe et al. | 131/299 |
| 3,721,527 | 3/1973 | Lodige et al. . | |
| 4,234,537 | 11/1980 | Hersom et al. . | |
| 4,301,819 | 11/1981 | Davies et al. . | |
| 4,315,515 | 2/1982 | Mills, III . | |
| 4,343,318 | 8/1982 | Brenik et al. . | |
| 4,528,993 | 7/1985 | Sensabaugh et al. . | |
| 4,545,392 | 10/1985 | Sensabaugh et al. . | |
| 4,660,577 | 4/1987 | Sensabaugh et al. . | |
| 4,844,933 | 7/1989 | Hsieh et al. . | |
| 4,848,373 | 7/1989 | Lenkey . | |

*Primary Examiner*—V. Millin
*Assistant Examiner*—J. Doyle

[57] ABSTRACT

The present invention relates to tobacco and more particularly to a process for preparing a moist snuff product and the stabilization thereof to reduce the level of microflora bacteria and to provide normal tasting products with extended shelf-lives.

11 Claims, 1 Drawing Sheet

STERILIZATION PROCESS IN THE MANUFACTURING OF SNUFF

BACKGROUND OF THE INVENTION

Due to their fermentation processes in manufacturing, moist snuffs, particularly those without bacteriostatic flavors like methyl salicylate, have limited shelf-lives. After processing, moist snuffs generally contain $10^5$ to $10^8$ organisms per gram. These residual organisms destroy the flavor and reduce product acceptability by generating off flavors.

Various processes are known for treating tobacco for preparation for use in smoking articles or for smokeless tobacco products such as moist snuff.

A number of references teach the treating of tobacco with heat and/or steam to obtain specific characteristics in a tobacco product. For example, U.S. Pat. No. 3,262,458 teaches a method for conditioning and adjusting the moisture content of bulk leaf tobacco under vacuum and steaming conditions, and U.S. Pat. No. 4,315,515 teaches an apparatus for drying tobacco under relatively high absolute humidity drying conditions to increase the filling power of tobacco.

Fermentation processes for tobacco are also known. For example, U.S. Pat. No. 4,343,318 teaches an endothermic fermentation method of processing the tobacco, and aging the tobacco in an atmosphere containing more than 25 percent volume oxygen and preferably in either pure oxygen or oxygen-enriched air.

There are also a number of references that teach processes for the curing of tobacco. Such an example is U.S. Pat. No. 1,327,692 which teaches a controlled process of curing tobacco which is claimed to shorten the curing time over air curing processes, wherein the tobacco is subjected to various temperatures and humidity levels for various time intervals.

There are also a number of references which teach the processing of tobacco utilizable for snuff products. For example, U.S. Pat. No. 4,528,993 teaches a method to produce snuff comprising the steps of hogs-heads aging tobacco for about two years, blending the tobacco to produce a snuff mixture, cutting the blended mixture into particles, casing the cut mixture by applying casing materials to the mixture, forced-aging the mixture by inducing chemical reactions, top-dressing the mixture, and adjusting the moisture level of the mixture to a range of about 45–55 percent and packaging the adjusted mixture. U.S. Pat. No. 4,660,577 teaches a dry pre-mix, combined with water to obtain moist snuff wherein the pre-mix consists of a mixture of snuff-type tobacco cut to a predetermined size with a moisture level of between 6 percent and 16 percent.

U.S. Pat. No. 4,848,373 teaches a process for preparing moist snuff wherein tobacco having a moisture content of 25 percent to 53 percent, is adjusted to a ph of 8 to 11 with an alkalizing agent and the tobacco is maintained in an aerobic environment at a temperature of 40° F. to 120° F., and at a pressure of one atmosphere for a period of 4 to 14 weeks.

There are also a number of references which teach sterilization processes for vegetable products, including tobacco. For example, U.S. Pat. No. 3,721,527 teaches a method of sterilizing bulk batches of material by means of steam or hot gas, and centrifugation of the batches of material in a closed chamber with simultaneous addition of sterilizing medium. U.S. Pat. No. 4,234,537 teaches a batch process for the sterilization of particulate solid material in which a batch of particulate solid material to be sterilized is introduced into a rotary vessel shaped so that rotation of the vessel imparts a tumbling action to the solid material, wherein the material is heated in the vessel during rotation and a liquid lubricant is subjected under pressure into the vessel at a temperature in excess of the temperature of the solid, and the lubricant liquid and the solid material are tumbled at a sterilization temperature. U.S. Pat. No. 4,844,933 teaches a method for sterilizing raw vegetable products such as herbs and spices. However, none of the heretofore mentioned references incorporate the sterilization process of the present invention before the addition of flavorants to manufacture a snuff product having enhanced flavor characteristics and a long shelf life.

Early attempts to develop moist snuff products have relied on pressure cooking and chemical additives to develop the desired color, texture, and pH of the product. Products which incorporate chemical preservatives or no preservatives suffer in product quality because the residual microorganisms literally eat the flavor compounds and degrade the tobacco product. All of the commercially known methods of stabilizing snuff products are directed toward sterilization of the products after the addition of the flavoring ingredients; however, the flavoring ingredients are subjected to heat degradation. The instant invention utilizes a stabilization process developed to prevent the loss of flavor and prevent the continued fermentation which greatly limits product shelf life.

In the present invention, a moist snuff product is prepared using traditional blending and fermentation processes such as are described in U.S. Pat. No. 4,660,577 and U.S. Pat. No. 4,528,993.

As disclosed in U.S. Pat. No. 4,528,993, snuff is composed primarily of tobaccos varieties such as Dark Fired, Green River, and One-Sucker tobaccos, primarily from Tennessee and Kentucky. Physically, these tobaccos are heavy-bodied, having long, wide leaves. The manufacture of tobacco snuff products requires that the tobacco have the desired flavor characteristics, and the ability to withstand snuff manufacturing processing. A traditional tobacco snuff blend may contain a mixture of leaves and stems.

Traditional snuff processing begins with tobacco which has been packed in hogsheads for aging. The tobacco is packed having a moisture content in the 15 to 25% range, and stored for a period of three to five years to aid in the fermentation of the snuff-type tobaccos. After the aged tobacco is removed from the hogshead, sufficient water is added to bring moisture content of the tobacco to the 20 to 25% range. The moist tobacco is then subjected to a fermentation process whereby bacteria produce enzymes which reduce the natural sugars present in the tobacco to produce the flavor precursors unique to moist snuff. During the fermentation process the temperature is controlled by agitating the tobacco to lower the fermentation temperature to control bacterial growth without killing the bacteria. This action avoids high temperature levels which kills the bacteria. The fermentation process is allowed to proceed at a slow rate, typically over several months, to convert the tobacco to snuff, but preventing over fermentation which would degrade the tobacco into a compost type of product.

The fermented snuff product is typically cut into the desired particle sizes, and additives such as salt and ash are traditionally used as preservatives to retard mold, or to control pH or further fermentation. Flavorants such as wintergreen, attar of rose, or other ingredients are added to give the product a distinctive flavor, and the moisture level is adjusted to that the final product has a moisture content of from 45 to 60%.

In the present invention a stabilization process is utilized after the fermentation step to reduce the level of bacteria in the fermented snuff product, and to retard microflora recovery and oxidation to promote longer shelf stability of the snuff product.

SUMMARY OF THE INVENTION

It is an object of the present invention to provide an improved process for manufacturing a moist snuff product.

It is another object of the present invention to provide a heat pasteurization process with no adverse effect on the flavor or the texture of the snuff product.

Another object of the present invention is to reduce the microflora level to preclude further in-package fermentation and enhance shelf life.

It is yet another object of the present invention provides a process for producing snuff which has a shelf life greater than the shelf life of heretofore known products.

Moreover, it is yet another object of the present invention to provide a shelf life of at least four months.

It is an even further object of the present invention to provide a stabilization process that is applicable for processing snuff products produced from various formulations and fermentation processes.

In the present invention, a moist snuff product is prepared using traditional blending and fermentation processes such as, for example, those described in U.S. Pat. No. 4,660,577 and U.S. Pat. No. 4,528,993. The tobacco product is then cooled and/or subjected to a pasteurization process to retard microflora recovery and oxidation.

More particularly, the present invention provides a stabilization process for producing snuff after the fermentation process, wherein the moist snuff contains from about $10^5$ to about $10^8$ organisms per gram. These residual organisms may destroy the flavor and reduce product acceptability by generating an off-flavor through continued fermentation. In the present invention, the fermented snuff product is subjected to a stabilization process, including pasteurization, wherein temperatures in the range of from about 175° F. to 250° F. reduce the microflora bacteria count to zero to about $10^2$ organisms per gram. At the zero to about $10^2$ level the microorganisms are no longer able to re-establish themselves to their original count or levels.

A more comprehensive understanding of the invention can be obtained by considering the following example, which demonstrates the preferred procedure that is followed in preparing moist snuff products in accordance with the present invention. However, it should be understood that the examples are not intended to be unduly limitative of the invention.

PREFERRED EMBODIMENT

Figure 1:
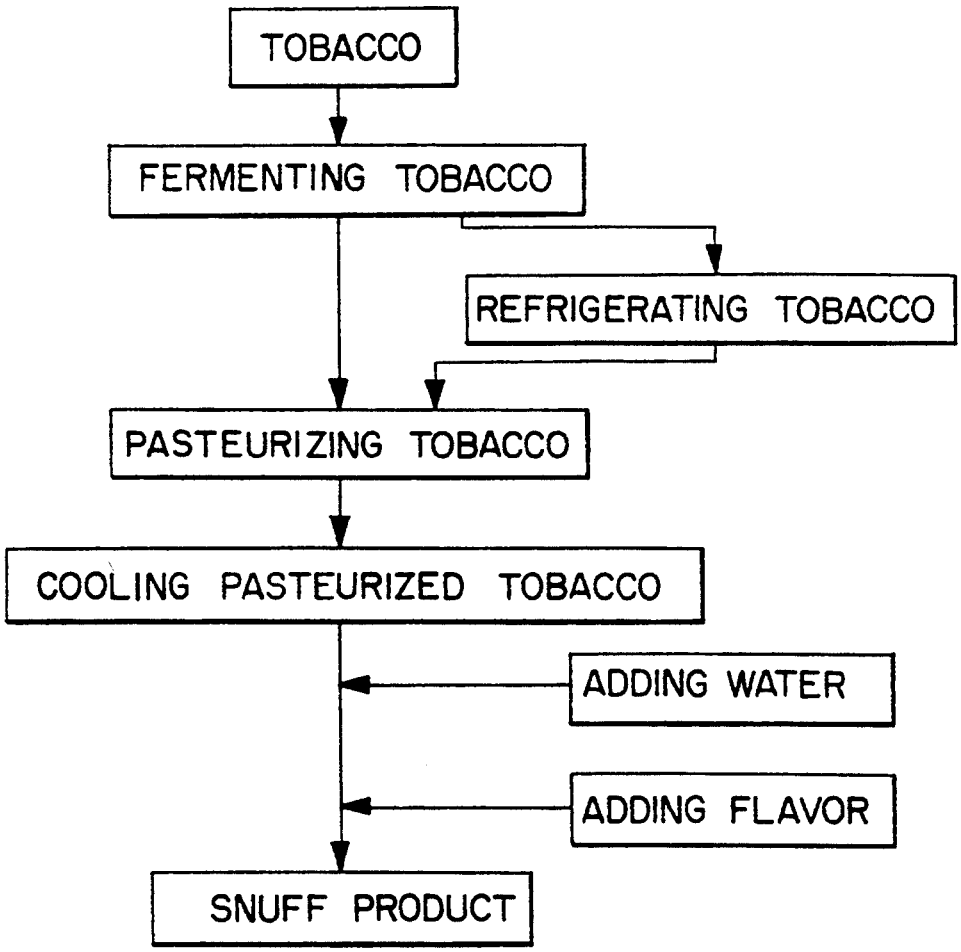
FIG. 1 is a flow chart of a preferred process of the present invention.

In accordance with FIG. 1, a process for preparing a moist snuff product by fermentation and the stabilization thereof after pasteurization reduces the level of microflora bacteria providing normal tasting products with extended shelf-lives. As shown in FIG. 1, after the desired level of fermentation has been obtained, such as set forth in U.S. Pat. No. 4,660,577 and U.S. Pat. No. 4,528,993, the tobacco product is subjected to the pasteurization process, or first temporarily stabilized by refrigeration pending heat stabilization by pasteurization. Refrigeration of the tobacco product at a temperature of from about 0° F. to about 40° F. halts fermentation at the completion of the fermentation stage and prevents "over fermentation". The tobacco product may be refrigerated for at least one month without experiencing adverse effects.

The preferred process for heat stabilization processing utilizes a pasteurization process accomplished using a "LITTLEFORD" brand cooker/mixer, which is a steam jacketed vessel with stirring plows to bring the tobacco product into contact with the heated walls. In the pasteurization step, the cooker/mixer containing the moist snuff product, is brought to a temperature of about 210° F., and is held at the 210° F. temperature for a period of approximately ten to twenty minutes. After this time, the heated moist snuff is cooled to room temperature by running ambient or preferably cool water through the cooker jacket. The entire heating and cooling cycle usually requires approximately twenty to thirty minutes, and no more than forty minutes. The pasteurization reduces the microflora by 99.9 percent to approximately 0 to $10^2$ organisms per gram which prevents further fermentation and flavor loss. Although not necessary, additional preservatives may be added to further retard microflora recovery and oxidation after the pasteurization process is completed.

The moisture content of the resulting snuff product may be adjusted to between about 50 and about 60 percent moisture content, the pH may be adjusted to the desired level of from about 7.5 to about 8.0, and flavors are then added to provide the desired taste and aroma to the resulting snuff product. Addition of the flavors after the sterilization process prevents heat degradation of the flavors, and retards microbial degradation oxidation of the resulting snuff product.

Although the preferred heat stabilization process is accomplished using a "LITTLEFORD" brand cooker, other types of heat transfer equipment such as a steam jacketed ribbon blender work as well. As set forth hereafter in Table I, alternative types of heat processing equipment which have been utilized to successfully sterilize snuff products include a thermodyne, a boiling container, and a microwave oven. A "SOLIDAIRE" brand heat exchanger, and electron beam sterilizer have also been found to be effective in the sterilization of fermented snuff products.

In Table I, a series of trial runs were made and the results of the decrease in the residual microflora bacteria content are shown. In the table, it is seen that generally as the time for processing increaes at a given temperature in the range of about 180° F. to about 220° F., the microflora bacteria count decreases until the residual microflora bacteria count is in the zero to about $10^2$organisms per gram (org/per gram) range. Moreover, for these temperatures of about 180° F. to about 220° F., it has been found that the other desirable attributes including the flavor and aroma characteristics of the snuff product are left intact.

TABLE I

| HEAT TRANSFER DEVICE | TIME | TEMPERATURE | RESIDUAL BACTERIA (ORG/PER GRAM) |
|---|---|---|---|
| THERMODYNE | 3 HRS | 175° F. | $1.0 \times 10^6$ |
| | 3 HRS | 175° F. | $1.1 \times 10^6$ |
| | 4 HRS | 175° F. | $1.2 \times 10^4$ |
| | 2 HRS | 200° F. | $1.7 \times 10^3$ |
| | 2 HRS | 200° F. | $1.1 \times 10^3$ |
| LITTLEFORD | | | $1.1 \times 10^5$ |
| | | 180° F. | $6.0 \times 10^4$ |
| CONTROL | 15 MIN | 220° F. | $1.1 \times 10^3$ |
| | 10 MIN | 210° F. | $1.8 \times 10^2$ |
| | 20 MIN | 210° F. | $2.3 \times 10^2$ |
| | 10 MIN | 210° F. | $3.7 \times 10^2$ |
| | 20 MIN | 210° F. | $2.0 \times 10^2$ |
| | 5 MIN | 210° F. | $1.1 \times 10^3$ |
| | 10 MIN | 210° F. | $2.1 \times 10^4$ |
| | 0 MIN | 210° F. | $1.2 \times 10^2$ |
| | 10 MIN | 210° F. | 0.0 |
| CONTROL | | | $2.8 \times 10^5$ |
| | 10 MIN | 210° F. | $3.0 \times 10^2$ |
| CONTROL | | | $2.4 \times 10^5$ |
| | 10 MIN | 210° F. | $3.0 \times 10^3$ |
| | 10 MIN | 210° F. | $6.6 \times 10^1$ |
| | 10 MIN | 210° F. | $6.1 \times 10^1$ |
| BOILING WATER BATH CONTROL | | | $1.4 \times 10^6$ |
| | 4 MIN | 212° F. | $2.4 \times 10^3$ |
| | 6 MIN | 212° F. | $3.5 \times 10^2$ |
| | 8 MIN | 212° F. | $7.0 \times 10^1$ |
| | 10 MIN | 212° F. | $2.1 \times 10^2$ |
| | 12 MIN | 212° F. | $7.0 \times 10^1$ |
| | 14 MIN | 212° F. | $7.0 \times 10^1$ |
| | 16 MIN | 212° F. | 0.0 |
| | 20 MIN | 212° F. | $6.6 \times 10^1$ |
| MICROWAVE (DEFROST POWER) | 3 MIN | 150° F. | $1.8 \times 10^5$ |
| | 4 MIN | 158° F. | $2.3 \times 10^4$ |
| | 5 MIN | 168° F. | $1.9 \times 10^4$ |
| | 9.5 MIN | 201° F. | 0.0 |
| | 8 MIN | 154° F. | $2.3 \times 10^4$ |
| | 9 MIN | 164° F. | $1.7 \times 10^4$ |
| | 10 MIN | 174° F. | $1.2 \times 10^4$ |
| | 13.5 MIN | 197° F. | $1.0 \times 10^4$ |
| MICROWAVE (HIGH POWER) | 3 MIN | 191° F. | $6.8 \times 10^3$ |
| | 4 MIN | 202° F. | $3.2 \times 10^2$ |
| | 5 MIN | 207° F. | $6.8 \times 10^2$ |

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. A stabilization process for making a snuff product comprising the steps of:

fermenting a snuff product; and pasteurizing said snuff product at an elevated temperature of less than about 250° F. for a selected time period to reduce the microflora bacteria count to no greater than about the $1 \times 10^2$level.

2. The stabilization process for making a snuff product as recited in claim 1, wherein:

said pasturizing temperature is from about 175° F. to about 250° F. for a period of from about 5 to about 20 minutes.

3. The stabilization process of claim 1, including the steps of cooling said pasteurized snuff product to ambient temperature.

4. The stabilization process of making said snuff product of claim 1, wherein said snuff product is a tobacco blend.

5. The stabilization process of making said tobacco snuff product as claimed in claim 4, wherein the moisture content of the final product is adjusted to about 45% to about 60% moisture content.

6. The stabilization process of claim 1, including adding flavor to said pasteurized snuff product.

7. The process of making moist snuff as claimed in claim 6, wherein said flavor is selected from the group consisting of sugars, cocoa, licorice, wintergreen, or rose flavor.

8. The stabilization process of making a snuff product as claimed in claim 1, wherein said stabilization of said pasteurized snuff product includes:

refrigerating said fermented snuff product at a temperature of from about 0° F. to about 40° F., thereby halting fermentation for preventing over fermenting of said snuff product and providing temporary stability pending heat stabilization by pasteurization.

9. The stabilization process of making a snuff product as claimed in claim 1, wherein said stabilization comprises the steps of:

pasteurizing said tobacco product by agitating and heating said tobacco product to a temperature of about 210° F. for a period of approximately ten to twenty minutes to retard microflora bacteria recovery and oxidation;

cooling said tobacco product to ambient temperature; and adding flavor additives to the pasteurized snuff product.

10. The process of making moist snuff as claimed in claim 9, wherein said flavor is selected from the group consisting of sugars, cocoa, licorice, wintergreen, or rose flavor.

11. The stabilization process of claim 9, including refrigerating said fermented snuff product at a temperature of from about 0° F. to about 40° F., halting the fermentation to prevent over fermentation and provide temporary stability pending heat stabilization by pasteurization.

* * * * *